US010256586B2

(12) United States Patent
Lee

(10) Patent No.: US 10,256,586 B2
(45) Date of Patent: Apr. 9, 2019

(54) METHOD OF RETROFITTING A TRADITIONAL ENERGY-SAVING LUMINAIRE

(71) Applicant: Siu Woo Lee, Foshan (CN)

(72) Inventor: Siu Woo Lee, Foshan (CN)

( * ) Notice: Subject to any disclaimer, the term of this patent is extended or adjusted under 35 U.S.C. 154(b) by 207 days.

(21) Appl. No.: 15/255,554

(22) Filed: Sep. 2, 2016

(65) Prior Publication Data

US 2018/0034223 A1 Feb. 1, 2018

(30) Foreign Application Priority Data

Jul. 26, 2016 (CN) ..... 2016 1 0595273
Jul. 26, 2016 (CN) ..... 2016 2 0793482 U

(51) Int. Cl.

| | |
|---|---|
| ***H01R 43/00*** | (2006.01) |
| ***H01R 31/06*** | (2006.01) |
| ***F21K 9/23*** | (2016.01) |
| ***F21V 23/06*** | (2006.01) |
| ***H01R 33/08*** | (2006.01) |
| ***H01R 33/94*** | (2006.01) |
| ***H01R 43/26*** | (2006.01) |

(52) U.S. Cl.

CPC ..... *H01R 31/06* (2013.01); *F21K 9/23* (2016.08); *F21V 23/06* (2013.01); *H01R 33/0809* (2013.01); *H01R 33/942* (2013.01); *H01R 43/26* (2013.01); *Y10T 29/49169* (2015.01)

(58) Field of Classification Search

CPC ..... H02J 9/065; F21Y 2115/10; F21V 23/06; F21V 13/04; F21V 7/00; F21K 9/275; F21K 9/23; Y10T 29/49169

USPC ..... 29/854, 428, 729, 747, 857, 868, 874

See application file for complete search history.

(56) References Cited

U.S. PATENT DOCUMENTS

| | | | | |
|---|---|---|---|---|
| 5,015,917 | A | 5/1991 | Nigg | |
| 6,544,058 | B1 | 4/2003 | Chang | |
| 6,739,734 | B1 * | 5/2004 | Hulgan ..... | F21S 8/02 362/217.05 |

(Continued)

FOREIGN PATENT DOCUMENTS

CN 104364580 A 2/2015

OTHER PUBLICATIONS

Canadian Intellectual Property Office, Office Action dated May 2, 2018 in Canadian Patent Application No. 2,941,178, 4 pages.

(Continued)

*Primary Examiner* — Thiem Phan
(74) *Attorney, Agent, or Firm* — Masuvalley & Partners

(57) ABSTRACT

The present disclosure relates to a G24 plug adaptor for use in retrofitting a traditional plug-in energy-saving luminaire, the traditional plug-in energy-saving luminaire initially adapted to receive a traditional energy-saving lamp, to be compatible with a non-traditional panel lamp such as, but not limited to, an energy-saving LED panel lamp. The G24 plug adaptor comprises a G24 plug base comprising a plurality of contact pins, an electrical connector adapted to couple to the non-traditional lamp, and an electrical supply line connecting the G24 plug base to the electrical connector. A method of retrofitting a traditional energy-saving luminaire to be compatible with a non-traditional panel lamp by using the G24 plug adaptor, the method comprising removing a reflector of the traditional plug-in energy-saving luminaire, is also disclosed herein.

8 Claims, 3 Drawing Sheets

(56) References Cited

U.S. PATENT DOCUMENTS

| | | | | |
|---|---|---|---|---|
| 7,223,126 | B2 | 5/2007 | Ng et al. | |
| 8,672,518 | B2 | 3/2014 | Boomgaarden et al. | |
| 2002/0076982 | A1 | 6/2002 | Tschope et al. | |
| 2011/0108402 | A1 | 5/2011 | Bowen et al. | |
| 2012/0161666 | A1* | 6/2012 | Antony ..... | H05B 33/0809 315/294 |
| 2014/0328066 | A1 | 11/2014 | Barnetson et al. | |

OTHER PUBLICATIONS

SIPO, 1st Office Action dated Dec. 1, 2017 in Chinese Patent Application No. 201610595273.4 (with English translation), 4 pages.

Office Action for Canadian Application 2941178, dated Jun. 22, 2017.

* cited by examiner

METHOD OF RETROFITTING A TRADITIONAL ENERGY-SAVING LUMINAIRE

TECHNICAL FIELD

The present disclosure relates to a plug adaptor for use in retrofitting a traditional energy-saving luminaire to be compatible with an otherwise incompatible lamp.

BACKGROUND

A traditional energy-saving luminaire is generally adapted to receive a traditional energy-saving lamp (e.g. a compact fluorescent lamp) and to provide a means for connecting the traditional energy-saving lamp to an electric source. Upon establishing electrical connection between the electric source and the lamp, illumination of the lamp is provided.

Different lamp types use different plug bases (i.e. electrical interfaces). Such plug bases include, but are not limited to, screw bases, specialty bases, pin bases, and plug-in bases. Traditional energy-saving lamps, for example, commonly utilize plug-in bases of, but not limited to, the G23, G24, GX24 and GX32 designation. Using a traditional energy-saving lamp with a G24 plug base as an example, the G24 plug base is adapted for coupling to (e.g. plugging into) a G24-compatible electrical socket. Such electrical socket is typically housed in the lamp holder of the traditional plug-in energy-saving luminaire. The electrical socket and the luminaire are typically disposed in a suitable location such as, but not limited to, the ceiling, a wall, or the ground.

Light-emitting diode (LED) panel lamps are an example of non-traditional energy-saving lamps that have become increasingly popular and widely adopted in industrial, commercial, and residential lighting applications. LED panel lamps are particularly known for their energy efficiency and for their ability to provide high lux. Panel lamps generally do not comprise traditional plug-in bases. For example, panel lamps generally do not comprise G24-compatible plug bases.

It would be desirable to be able to retrofit a traditional energy-saving luminaire, for example a traditional plug-in energy-saving luminaire, to be compatible with non-traditional energy-saving lamps, such as LED panel lamps.

SUMMARY

The present disclosure relates to a plug adaptor for use in retrofitting a traditional (i.e. existing) plug-in energy-saving luminaire, the luminaire adapted to receive a traditional energy-saving lamp in the first instance, to be compatible with an otherwise incompatible energy-saving lamp.

An object of the present disclosure is to provide a means of retrofitting an existing energy-saving luminaire to be compatible with an otherwise incompatible energy-saving lamp, for example an LED panel lamp, without substantially altering the fitting seat of the existing energy-saving luminaire.

According to an aspect of the disclosure, there is a G24 plug adaptor for use in retrofitting a traditional energy-saving luminaire to be compatible with a panel lamp, the G24 plug adaptor comprising: (i) a G24 plug base comprising a plurality of contact pins; (ii) an electrical connector adapted to couple to the panel lamp; and (iii) an electrical supply line connecting the G24 plug base to the electrical connector.

The panel lamp may be an energy-saving panel lamp such as, but not limited to, a light-emitting diode panel lamp.

The electrical connector may comprise a female screw joint that is compatible with an electrical connector of the panel lamp. A non-limiting example of a suitable female screw joint is a direct-current based female buckle-end.

The traditional plug-in energy-saving luminaire may be installed in a ceiling.

According to another aspect of the disclosure, there is a method of retrofitting a traditional energy-saving luminaire to be compatible with a panel lamp, the method comprising: (a) removing a reflector of the traditional energy-saving luminaire; (b) providing a G24 plug adaptor comprising a G24 plug base comprising a plurality of contact pins, an electrical connector adapted to couple to the panel lamp, and an electrical supply line connecting the G24 plug base to the electrical connector; (c) coupling the G24 plug base to a G24-compatible electrical socket of the traditional energy-saving luminaire; (d) coupling the electrical connector of the G24 plug adaptor to the panel lamp; and (e) coupling the panel lamp to the traditional energy-saving luminaire.

The panel lamp may be coupled to a housing of the traditional energy-saving luminaire by interference-fitting, press-fitting, or friction-fitting.

The panel lamp may be coupled to a housing of the traditional energy-saving luminaire by mechanically fastening the panel lamp to the housing This summary does not necessarily describe all features of the invention.

BRIEF DESCRIPTION OF DRAWINGS

In the accompanying drawings, which illustrate one or more example embodiments.

DETAILED DESCRIPTION

Directional terms such as "top," "bottom," "upwards," "downwards," "vertically," and "laterally" are used in the following description for the purpose of providing relative reference only, and are not intended to suggest any limitations on how any article is to be positioned during use, or to be mounted in an assembly or relative to an environment. The use of the word "a" or "an" when used herein in conjunction with the term "comprising" may mean "one," but it is also consistent with the meaning of "one or more," "at least one" and "one or more than one." Any element expressed in the singular form also encompasses its plural form. Any element expressed in the plural form also encompasses its singular form. The term "plurality" as used herein means more than one, for example, two or more, three or more, four or more, and the like.

As used herein, the terms "comprising," "having," "including" and "containing," and grammatical variations thereof, are inclusive or open-ended and do not exclude additional, un-recited elements and/or method steps. The term "consisting essentially of" when used herein in connection with a composition, use or method, denotes that additional elements, method steps or both additional elements and method steps may be present, but that these additions do not materially affect the manner in which the recited composition, method or use functions. The term "consisting of" when used herein in connection with a composition, use or method, excludes the presence of additional elements and/or method steps.

The present disclosure relates to a G24 plug adaptor for use in retrofitting a traditional (i.e. existing) plug-in energy-saving luminaire, the luminaire adapted to receive a traditional energy-saving lamp in the first instance, to be compatible with an otherwise incompatible energy-saving lamp such as, but not limited to, a panel lamp. A non-limiting example of a panel lamp is an LED panel lamp. Through the use of the G24 plug adaptor, a traditional plug-in energy-saving luminaire may be retrofitted without having to substantially alter the lamp fitting seat of the traditional plug-in energy-saving luminaire.

Figure 1:
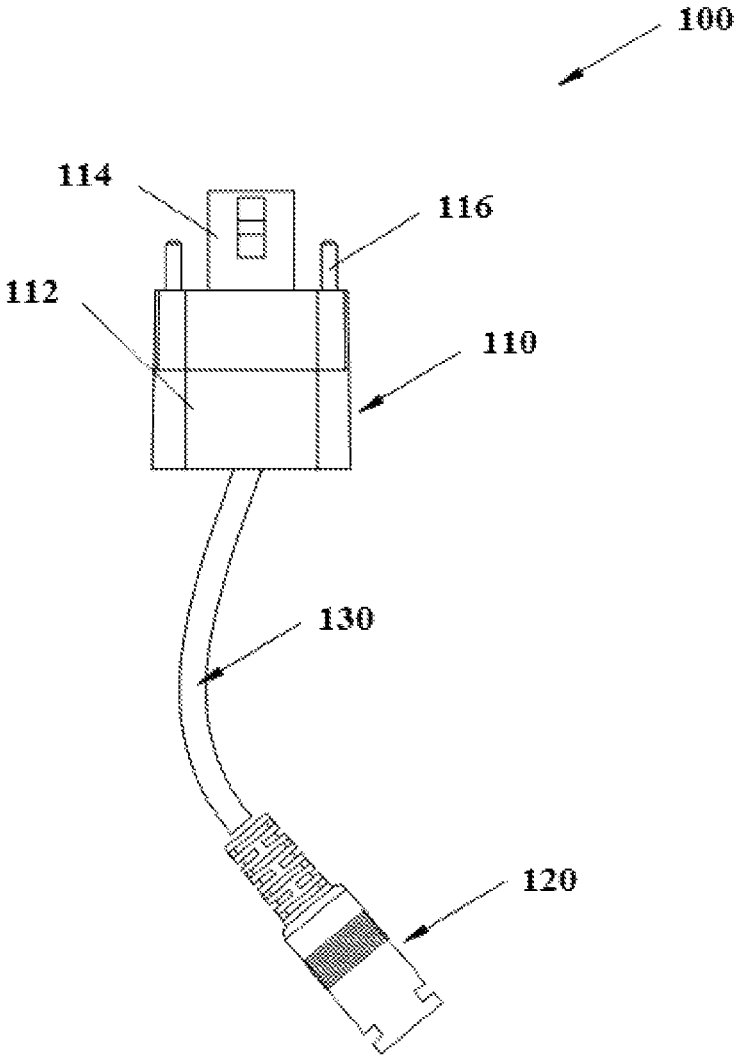
FIG. 1 is a side view a G24 plug adaptor, the G24 plug adaptor comprising a G24 plug base, an electrical connector, and an electrical supply line connecting the G24 plug base to the electrical connector.
Figure 2:
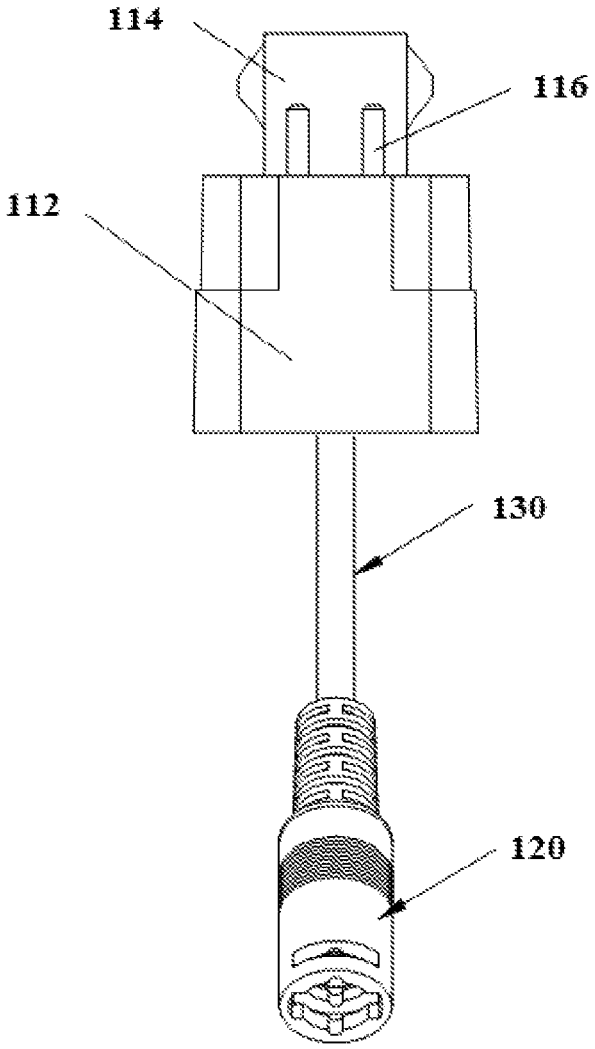
FIG. 2 is a front view of the G24 plug adaptor shown in FIG. 1.
Figure 3:
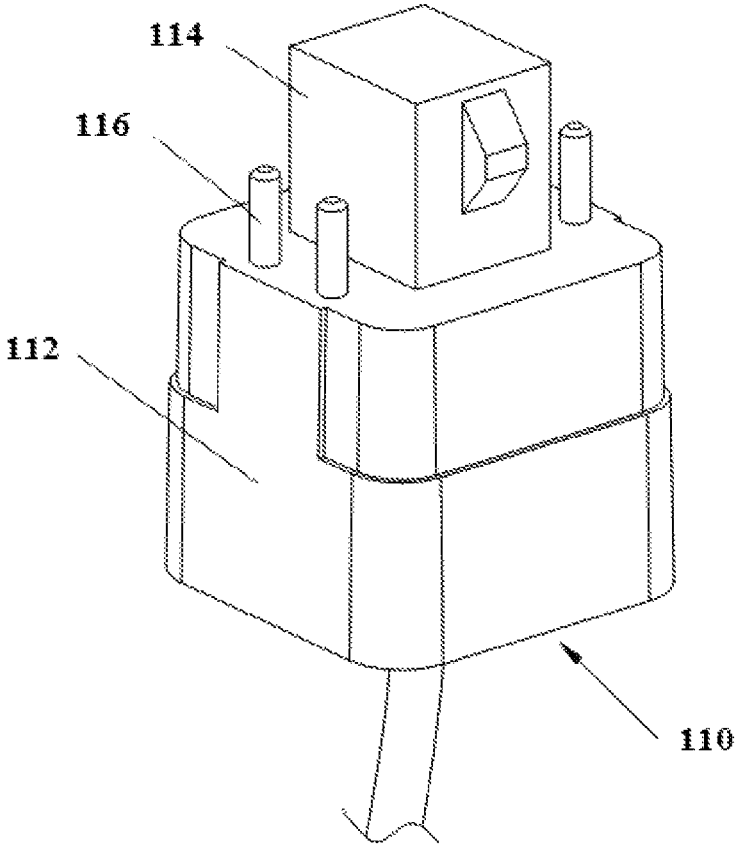
FIG. 3 is a perspective view of the G24 plug base of the G24 plug adaptor.

Referring to FIGS. 1 to 3 and according to an embodiment of the present disclosure, there is a G24 plug adaptor 100 comprising a G24 plug base 110, an electrical connector 120, and an electrical supply line 130 connecting the G24 plug base 110 to the connector 120.

The G24 plug base 110 comprises a configuration, shape, and electric components that are generally known in the art. For example, and as shown in FIG. 3, the G24 plug base 110 comprises a plug seat 112, a quadrangle unit 114, and a plurality of (e.g. 2, 3, 4, etc. . . . ) electrical contact pins 116, the contact pins 116 adapted for electrical connection with a G24-compatible electrical socket. The contact pins 116 are made of a suitable conducting material such as, but not limited to, copper. The G24 plug base 110 is made of any suitable material known in the art such as, but not limited to, polycarbonate and other suitable plastic material.

While depicted in FIG. 3 as generally being rounded-rectangular in shape, the G24 plug base 110 may be any suitable shape such as, but not limited to, circular, ovoidal, and triangular, cubic, rectangular, pentagonal and other polygonal shape. The G24 plug base 110 may be of any suitable dimension.

The electrical supply line 130 possesses a first end and a second end. The first end of the electrical supply line 130 is connected to the G24 plug base 110. The second end of the electrical supply line 130 is connected to the electrical connector 120. The electrical supply line serves as a medium for delivering electrical current from the G24 plug base 110 to the electrical connector 120, and as a result to the electric device (e.g. an LED lamp) to which the electrical connector 120 is connected.

The means by which the electrical supply line 130 and the G24 plug base 110 are coupled, and the means by which the electrical supply line 130 and the electrical connector 120 are coupled, are generally known in the art. In an example, the first end of the electrical supply line 130 may have male contacts (not depicted) that are insertable into a receiving electric socket (not depicted) located in the G24 plug base 110, the male contacts then being connected with the contact pins 116. In another example, the first end of the electrical supply line 130 may be electrically wired in connection with the contact pins 116 (see for example U.S. 2011/0108402 and U.S. Pat. No. 7,223,126). In another example, the second end of the power conduit 130 may be electrically wired with the electrical connector 120. The electrical supply line 130 may be, but is not limited to, an electrical connection cable or an electrical connection cord. The electrical supply line 130 may be rigid or flexible or semi-flexible.

The electrical connector 120 is adapted for coupling to a complementary electrical connector (not shown) of a non-traditional energy-saving lamp such as, but not limited to, a panel lamp (e.g. LED panel lamp). As contemplated in this embodiment, the electrical connector 120 comprises a female screw joint. A non-limiting example of a suitable female screw joint is a direct-current based female buckle-end. In other embodiments, the electrical connector 120 comprises a suitable connection design that is generally known in the art. The exterior of the electrical connector 120 is made of any suitable insulating material such as, but not limited to, a hard plastic coated with a rubber or silicon over-layer.

The G24 plug adaptor 100 is adapted to be receivable by any standard G24-compatible electrical socket known in the art. It is herein contemplated that the G24 plug adaptor 100 coupled to a non-traditional lamp (e.g. panel lamp; not shown) may be installed in a traditional plug-in energy-saving luminaire disposed in any suitable location such as, but not limited to, the ceiling, a wall, or the ground.

When retrofitting a traditional plug-in energy-saving luminaire, a reflector inside the lamp holder of the traditional plug-in energy-saving luminaire is first removed. After removal of the reflector, the G24 plug adaptor 100 is coupled to the G24-compatible electrical socket, the socket being located in the lamp holder of the luminaire. More specifically, the electrical contact pins 116 of the G24 plug adaptor 110 are inserted into the complementary female receptacles of the G24-compatible electrical socket, the socket being located in the lamp holder of the luminaire, the socket and luminaire being located in a suitable location such as, but not limited to, the ceiling, a wall, or the ground.

When retrofitting the traditional plug-in energy-saving luminaire, the electrical connector 120 is coupled to a complementary electrical connector of the non-traditional lamp (not shown). Non-limiting examples of a suitable non-traditional lamp include, but are not limited to, a panel lamp, for example an LED panel lamp. Using a female screw joint connector as an example of a suitable electrical connector 120, the electrical connector 120 is coupled to the complementary male screw joint connector of the non-traditional lamp. At this point, the non-traditional lamp would achieve full electrical connection through the G24 plug adaptor 100 within a traditional plug-in energy-saving luminaire setting.

When retrofitting the traditional plug-in energy-saving luminaire, the non-traditional lamp is secured into and over an opening of the lamp holder of the traditional energy-saving luminaire. In an example, the panel lamp is mechanically fastened to a rim of the lamp holder of the traditional luminaire by fastening means such as screws. In another example, the panel lamp is press-fitted, interference-fitted, or friction-fitted into the opening of the lamp holder of the traditional energy-saving luminaire.

Through the use of the presently disclosed G24 plug adaptor 100, a traditional plug-in energy-saving luminaire may be retrofitted with an energy-saving panel lamp without having to alter the fitting seat (i.e. the fitting between the plug seat 112 and the G24-compatible electrical socket of the lamp holder of the traditional plug-in energy-saving luminaire) of the traditional luminaire holder. Through such retrofitting, and by substantially retaining the structure of the original fitting seat of the traditional luminaire holder, a traditional plug-in energy-saving luminaire may provide strong illumination for each lumen of light produced through the attached panel lamp. Retrofitting existing traditional plug-in energy-saving luminaires extends the life of such existing luminaires, thereby minimizes waste and pollution.

It is contemplated that any part of any aspect or embodiment discussed in this specification can be implemented or combined with any part of any other aspect or embodiment discussed in this specification. While particular embodiments have been described in the foregoing, it is to be understood that other embodiments are possible and are intended to be included herein. It will be clear to any person skilled in the art that modification of and adjustment to the foregoing embodiments, not shown, is possible. The scope of the claims should not be limited by the preferred embodiments described herein, but should be given the broadest interpretation consistent with the description as a whole.

What is claimed is:

1. A method of retrofitting a traditional energy-saving luminaire to be compatible with a panel lamp, the method comprising:

(a) removing a reflector of the traditional energy-saving luminaire;

(b) providing a G24 plug adaptor comprising a G24 plug base comprising a plurality of contact pins, an electrical connector adapted to couple to the panel lamp, and an electrical supply line connecting the G24 plug base to the electrical connector;

(c) coupling the G24 plug base to a G24-compatible electrical socket of the traditional energy-saving luminaire;

(d) coupling the electrical connector of the G24 plug adaptor to the panel lamp; and (e) coupling the panel lamp to the traditional energy-saving luminaire.

2. The method according to claim 1, wherein the electrical connector of the G24 plug adaptor comprises a female screw joint.

3. The method according to claim 2, wherein the female screw joint is a direct-current based female buckle-end.

4. The method according to claim 2, wherein the female screw joint is coupled to an electrical connector of the energy-saving panel lamp.

5. The method according to claim 4, wherein the electrical connector of the energy-saving panel lamp is a male screw joint.

6. The method according to claim 1, wherein the traditional energy-saving luminaire is installed in a ceiling.

7. The method according to claim 1, wherein the panel lamp is coupled to a housing of the traditional energy-saving luminaire by interference-fitting, press-fitting, or friction-fitting.

8. The method according to claim 1, wherein the panel lamp is coupled to a housing of the traditional energy-saving luminaire by mechanically fastening the panel lamp to the housing.

* * * * *